United States Patent [19]

Votta et al.

[11] 3,946,180

[45] Mar. 23, 1976

[54] DOWNSTREAM INJECTION NOZZLE FOR PUFFER CIRCUIT INTERRUPTER

[75] Inventors: Gerald A. Votta, Prospect Park; Leonard J. Kucharski, Harleysville, both of Pa.

[73] Assignee: I-T-E Imperial Corporation, Spring House, Pa.

[22] Filed: Apr. 22, 1974

[21] Appl. No.: 462,611

[52] U.S. Cl. ..... 200/148 A; 200/150 G

[51] Int. Cl.[2] ..... H01H 33/88

[58] Field of Search..... 200/148 A, 150 G, 148 G

[56] References Cited

UNITED STATES PATENTS

| | | | |
|---|---|---|---|
| 1,141,158 | 6/1915 | Turner | 200/148 A |
| 3,150,245 | 9/1964 | Leeds et al. | 200/148 G |
| 3,406,269 | 10/1968 | Fischer | 200/148 G |
| 3,679,851 | 7/1972 | Latour et al. | 200/148 A |
| 3,739,125 | 6/1973 | Noeske | 200/148 A |

*Primary Examiner*—Robert S. Macon

*Attorney, Agent, or Firm*—Ostrolenk, Faber, Gerb & Soffen

[57] ABSTRACT

The nozzle of a puffer type breaker is provided with a plurality of ports of different downstream lengths having different diameters and angles of entry which communicate from the region at generated high pressure into the arcing region within the nozzle.

7 Claims, 5 Drawing Figures

DOWNSTREAM INJECTION NOZZLE FOR PUFFER CIRCUIT INTERRUPTER

BACKGROUND OF THE INVENTION

This invention relates to single pressure, puffer type gas interrupters for circuit breakers, and more specifically relates to a novel nozzle construction for such interrupters which provide relief against a rapidly increasing pressure within the nozzle throat which thereafter provides for the turbulent mixing of heated gas within the nozzle with a radial blast of cold gas jets.

Single pressure puffer type gas interrupters are well known in the art. In these interrupters, a pair of contacts is separated in the region of a nozzle which directs a gas flow through the separating contacts. The gas flow is in turn produced by the relative movement of a piston and cylinder, one of which is connected to and moves with the movable contact of the interrupter. The heat of the arc drawn between the separating contacts produces a high gas pressure which acts in opposition to the operating mechanism force which moves the movable contact and pressure generating piston (or cylinder). Thus, the operating mechanism must be increased in size in order to overcome arc-generated gas pressure. This same arc-generated gas pressure is known to increase exponentially if the arc plasma blocks the nozzle throat to prevent cold gas or gas which flows from the pistoncylinder region from mixing with the arc.

BRIEF SUMMARY OF THE INVENTION

In accordance with the present invention, the nozzle is provided with a plurality of ports or openings through the nozzle wall and which communicate with the piston-cylinder volume which is being compressed in order to allow cool gas flow to the interior of the nozzle. These ports may have varying diameters and varying angles of entry into the nozzle interior and may have varying downstream lengths. Thus, the ports will act to cause a turbulent mixing of the arc generated pressure plasma with a radial blast of a number of jets of cold deionized gas. This then prevents the rapid increase of generated blast pressure which might otherwise block the movement of new gas through the nozzle throat. Thus, relatively small operating mechanisms can be used to operate the breaker, while the mixing of cold fresh gas with the arc plasma will assist in the interruption of the arc.

DETAILED DESCRIPTION OF THE DRAWINGS

Figure 1:
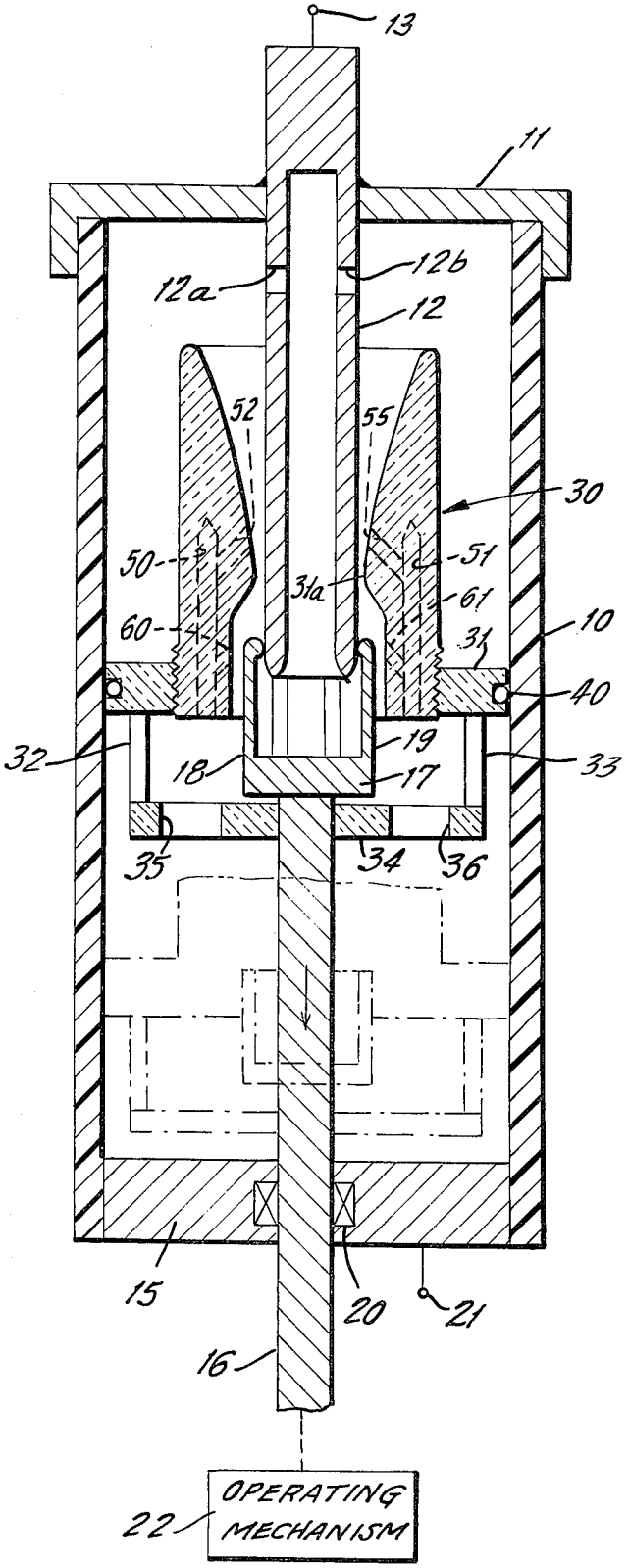
FIG. 1 is a cross-sectional view of a puffer type interrupter which uses the novel nozzle of the present invention.

Referring first to FIG. 1, there is schematically shown a conventional puffer interrupter which could be of any desired type and which is adapted with the nozzle of the present invention. Thus, in FIG. 1 the interrupter is contained within a cylindrical insulation housing or tube 10 which has an upper end cap 11 secured thereto in any desired manner and which carries a hollow elongated stationary contact tube 12. Note that the stationary contact tube 12 may have ports, such as ports 12*a* and 12*b*, which permit circulation of gas during the operation of the interrupter through the center of the contact tube 12 and then back to the interior volume within housing 10. One interrupter terminal 13 will be connected to the stationary contact 12. Preferably the cap 11 will be sealed to both the upper end of tube 10 and to the stationary contact 12 so that there can be no gas leakage from the interior of tube 10.

The tube 10 is filled with a suitable gas such as sulfur hexafluoride which can be at atmospheric pressure. Other gases can also be used as desired by the designer.

The bottom of tube 10 then carries a conductive disk 15 which is sealed to the periphery of tube 10 in any desired manner and which slidably receives a conductive operating rod 16. The conducting operating rod 16 is electrically and mechanically connected to the movable contact 17 which may terminate in segmented contact fingers, such as fingers 18 and 19 which slidably engage the end of the stationary contact tube 12.

A transfer contact 20 is then provided between operating rod 16 and the conductive disk 15 so that the disk 15 can serve as the second terminal 21 of the interrupter.

A conventional operating mechanism 22 of any desired type is connected to the operating rod 16 and is capable of moving the operating rod 16 downwardly and to move the various components to a disengaged position as will be later described.

A nozzle 30, made of a material such a polytetrafluoroethylene (Teflon), or the like, which is the subject of the present invention, is then mechanically connected to the rod 16 through the intermediaries of insulation disk 31, which is connected by a plurality of rods including rods 32 and 33 to the insulation disk 34 which is secured directly to rod 16. The disk 34 contains apertures, such as apertures 35 and 36, which permit copious gas flow therethrough as the movable structure moves downwardly to the dotted-line position shown for the open circuit condition of the interrupter.

The disk 31 is sealed to the interior diameter of tube 10 by a sliding seal 40 which enables sealed but ready sliding action between disk 31 and the wall of tube 10. Thus, the disk 31 serves as a piston within a cylinder defined by the walls of tube 10 and the conductive disk 15. Therefore, when the contacts move to their disengaged position by moving the operating rod 16 downwardly, the disk 31 reduces volume beneath it thereby to force a blast of gas under pressure through apertures 35 and 36 and thence through the nozzle 30. This gas flows between the separating contacts and through the arc drawn between the contacts and continues to flow to sweep the arcing space free of ionization products after arc extinction so that the open contact gap can withstand the recovery voltage of the circuit which is interrupted.

During an interruption action, the contact fingers such as fingers 18 and 19 move downwardly and draw an arc to the bottom of the stationary contact 12 which may have a special arcing contact material at the end thereof. The downward movement of disk 31 compresses the gas below it to begin a gas blast through the nozzle but, at the same time, the high temperature arc within the nozzle throat 31*a* causes the generation of a blast pressure which increases exponentially, particularly when the arc plasma blocks the nozzle throat 31*a*. This then opposes the motion of fresh gas into the nozzle from beneath disk 31 to mix with the arc plasma to assist in its extinction. Moreover, this generated blast pressure sets up a force in opposition to the operating force on operating rod 16 which attempts to move the entire movable structure downwardly. An increased size operating mechanism is therefore needed to overcome this additional restraining force.

In accordance with the invention, a plurality of injection ports are formed in the nozzle 30 to permit the flow of cool gas from beneath disk 31 into regions which may be both upstream and downstream of the nozzle throat 31*a*.

Figure 3:
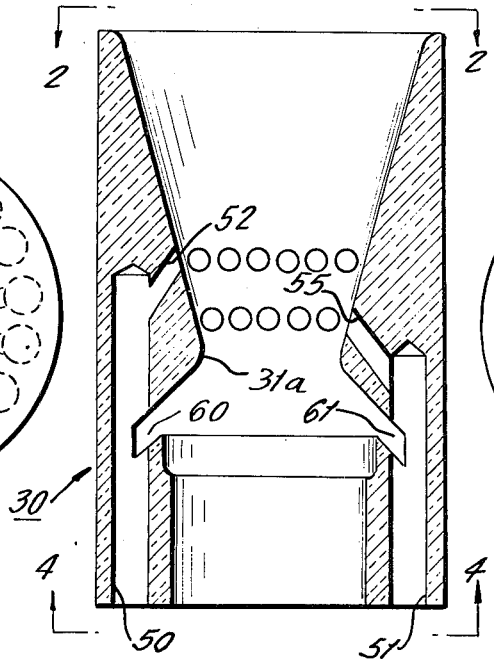
FIG. 3 is a cross-sectional view of FIG. 2 taken across section line 3—3 in FIG. 2.
Figure 2:
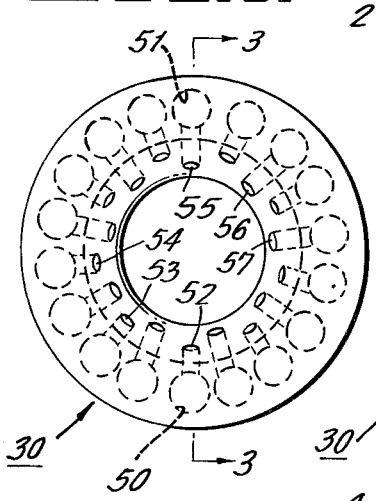
FIG. 2 is an end view of the nozzle of the present invention which is used in FIG. 1.

A first embodiment of a nozzle constructed in this manner is shown in FIGS. 1 to 4 where the nozzle 30 has a plurality of axially directed vents extending from the bottom of the nozzle 30 in FIGS. 1 and 3 into radially directed venting regions which lead into the interior of the nozzle. Thus, in FIG. 4 it is seen that the bottom of the nozzle is provided with a plurality of axially directed channels including channels 50 and 51 where alternate channels terminate in downstream ports, such as ports 52 (FIGS. 2 and 3) and 53 and 54 (FIG. 2). Alternate channels such as channel 51 terminate in the ports in the nozzle 30 which are upstream of ports 52, 53 and 54 and include ports 55, 56 and 57 of FIGS. 2 and 3. Still further ports may be defined in each of the elongated or axially directed channels, such as channels 50 and 51, including ports 60 and 61 in FIG. 3 which feed into regions upstream of the nozzle throat 31*a*.

Figure 4:
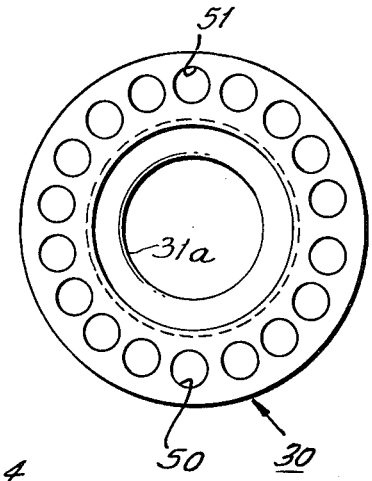
FIG. 4 is a right-hand end view of the nozzle of FIG. 3.

It will thus be seen that the nozzle 30 constructed in the manner best shown in FIGS. 2, 3 and 4 will form a downstream injection path internally of the nozzle 30 with the injection ports at different downstream positions as shown for the different downstream locations of the exits of ports 52 and 55 in FIG. 3. Moreover, these various ports may have varying diameters and will have different angles of entry. This will then provide relief against rapidly increasing pressure within the nozzle throat 31*a* and ensures that there will be a turbulent mixing of the arc plasma with the cold gas from the various radial blast injection ports.

Figure 5:
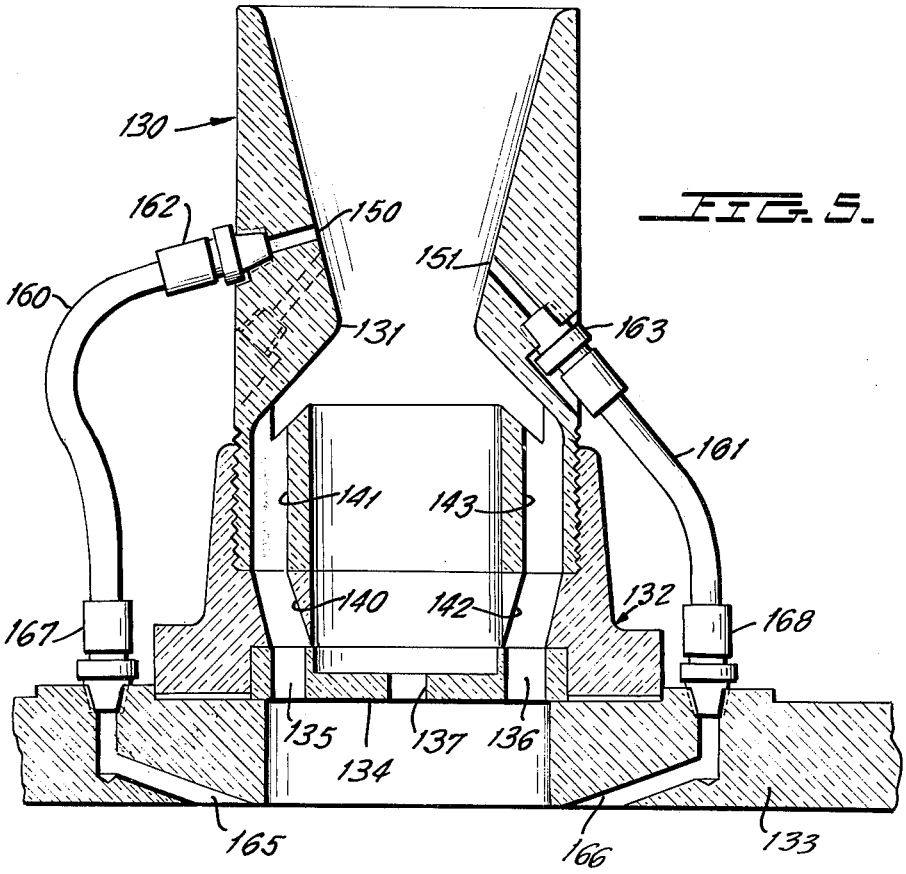
FIG. 5 is a cross-sectional view of a second embodiment of the invention wherein the gas injection path is external to the nozzle.

In the arrangement of FIGS. 1 to 4, the nozzle 30 derives gas from directly beneath the disk or piston 31. FIG. 5 shows a second embodiment of the invention for a nozzle 130 which has a nozzle throat 131 wherein radial gas is introduced from regions exterior of the nozzle. The nozzle 130 is the full equivalent of nozzle 30 in FIG. 1 and could be assembled into an interrupter in the manner generally shown for nozzle 30 in FIG. 1. In FIG. 5, however, the nozzle 130 is supported by an intermediate insulation nozzle support member 132 which is threaded to the exterior of nozzle 130 with support 132 being ultimately supported on a disk 133 which is the equivalent of the disk 31 in FIG. 1. Nozzle 130 and disk 133 move with the movable contact structure of the interrupter.

A ring 134 having apertures therethrough such as apertures 135, 136 and 137 is captured between support 132 and disk 133. Note that apertures 135 and 136 are two apertures of a ring of apertures which are distributed around the ring 134. The nozzle support 132 and the nozzle 130 have aligned openings which are generally axially directed including aligned openings 140–141 and 142–143 respectively. These openings are further aligned with openings 135 and 136 in disk 137 to define a full channel extending from the bottom of the disk or piston 133 and into the interior of the nozzle 130 but slightly downstream of nozzle throat 131. Clearly, a large number of channels such as channel openings 141 and 143 will be distributed around the circumference of the nozzle 130.

A plurality of pairs of injection ports are further provided in the nozzle and include ports 150 and 151 in FIG. 5 which each have different angles of entry into a region which is downstream of the nozzle throat 131. A plurality of such ports are provided in a manner analogous to the various ports 52 to 57 in FIG. 2 where ports at different downstream locations alternate with one another.

Each of the various ports is then coupled to conduits, such as conduits 160 and 161, which are connected to ports 150 and 151 by nipple connectors 162 and 163, respectively. Conduits 160 and 161 have their bottom ends connected to ports such as 165 and 166 in disk 133 by the nipple connectors 167 and 168, respectively.

It will be noted from a consideration of FIGS. 1 and 5 that, as the interrupter contacts separate, a pressure is built up beneath the piston 133 of FIG. 5. Gas will then flow through the various apertures in disk 134 and into the interior of the nozzle 130 while a further gas passage is provided through the various conduits such as conduits 160 and 161 to produce a turbulent gas flow of relatively cold gas downstream of the nozzle throat 131.

It will be noted that the injection path which contains ports 150 and 151 in FIG. 5 is external of the nozzle 130 as contrasted to the path shown in the embodiment of FIGS. 2, 3 and 4, where the gas flows through channels directly in the nozzle.

By using an externally directed path as in FIG. 5, the entrance of gas into the ports 165 and 166 is further from the area of arc plasma generation and will, therefore, be in a less excited state than the gas which might enter the various ports in the embodiments of FIGS. 2, 3 and 4.

Although this invention has been described with respect to preferred embodiments, it should be understood that many variations and modifications will now be obvious to those skilled in the art, and it is preferred, therefore, that the scope of this invention be limited, not by the specific disclosure herein, but only by the appended claims.

The embodiments of the invention in which an exclusive privilege or property is claimed are defined as follows.

1. A nozzle structure for a puffer type interrupter; said puffer type interrupter including a pair of separable contacts, a gas flow directing nozzle of insulation material which concentrically surrounds said pair of separable contacts for directing a flow of gas through arcs drawn between said pair of separable contacts as they separate; said gas flow directing nozzle having open opposite ends; gas pressure generating means connected to one of said opposite ends for producing a flow of gas in a single direction, and through said nozzle from said one of its said opposite ends to the other of said opposite ends at least while said pair of separable contacts are opening; said flow of gas in a single direction being generally along the axis of said nozzle and said pair of contacts moving generally along the axis of said nozzle when said pair of contacts separate; said nozzle having a throat restriction generally upstream of the region of contact separation between said pair of separable contacts; and a plurality of ports extending into the interior surface of said nozzle at an axial location generally downstream of said throat restriction; one end of said ports being connected to regions upstream of said nozzle restriction and injecting a turbulent flow of relatively cool gas downstream of said nozzle during the separation of said pair of contacts; the other end of said ports being connected to said gas pressure generating means; said gas pressure generating means including a relatively movable piston and cylinder connected to said pair of separable contacts, whereby a flow of gas is produced through said nozzle when said pair of separable contacts is operated; said nozzle including generally axially extending channels therein for connecting said other end of said plurality of ports to said gas pressure generating means.

2. The nozzle structure of claim 1 wherein said gas includes sulfur hexafluoride as at least one component thereof.

3. The nozzle structure of claim 1 which includes a second plurality of ports in said nozzle which are positioned alternately with said plurality of ports and which have port exits in the interior of said nozzle which are axially between said plurality of ports and said nozzle throat restriction.

4. The nozzle structure of claim 1 wherein said nozzle includes external conduit means for connecting said plurality of ports to said regions upstream of said nozzle restriction.

5. The nozzle structure of claim 3 wherein said second plurality of ports have a different entrance angle to the axis of said nozzle than the entrance angle of said plurality of ports.

6. The nozzle structure of claim 1 which further includes a plurality of upstream ports connected through said nozzle and extending from the interior of said nozzle at a region upstream of said throat restriction to regions further upstream of said nozzle.

7. The nozzle structure of claim 3 which further includes a plurality of upstream ports connected through said nozzle and extending from the interior of said nozzle at a region upstream of said throat restriction to regions further upstream of said nozzle.

* * * * *